US011124739B2

(12) United States Patent
Rosmaninho et al.

(10) Patent No.: US 11,124,739 B2
(45) **Date of Patent: *Sep. 21, 2021**

(54) CLEANING PRODUCT

(71) Applicant: The Procter & Gamble Company, Cincinnati, OH (US)

(72) Inventors: Roxane Rosmaninho, Auderghem (BE); Mate Debreczeni, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/010,828

(22) Filed: Jun. 18, 2018

(65) Prior Publication Data

US 2018/0371364 A1 Dec. 27, 2018

(30) Foreign Application Priority Data

Jun. 22, 2017 (EP) ..... 17177275
Jan. 24, 2018 (EP) ..... 18153117

(51) Int. Cl.
*C11D 1/29* (2006.01)
*C11D 1/72* (2006.01)
(Continued)

(52) U.S. Cl.
CPC ..... *C11D 1/83* (2013.01); *C11D 1/123* (2013.01); *C11D 1/146* (2013.01); *C11D 1/72* (2013.01);
(Continued)

(58) Field of Classification Search
CPC .. C11D 1/123; C11D 1/29; C11D 1/72; C11D 1/75; C11D 1/83; C11D 3/10;
(Continued)

(56) References Cited

U.S. PATENT DOCUMENTS 4,670,171 A 6/1987 Magyar
5,925,606 A 7/1999 Stamm
(Continued)

FOREIGN PATENT DOCUMENTS

DE 3004835 A1 8/1981
DE 102006003336 A1 7/2007
(Continued)

OTHER PUBLICATIONS

Search Report; Serial No. PCT/US2018/038006; dated Jul. 27, 2018; 13 Pages.
(Continued)

*Primary Examiner* — Brian P Mruk
(74) *Attorney, Agent, or Firm* — Melissa Krasovec

(57) ABSTRACT

A cleaning product having a spray dispenser and a cleaning composition suitable for spraying and foaming, the composition is housed in the spray dispenser and the composition includes: i) from 7% to 12% by weight of the composition of a surfactant system; and ii) from 1% to 15% by weight of the composition of a low cut alcohol alkoxylate non-ionic surfactant. It is an object to provide a product that makes the cleaning of dishware easier and faster. It has now been found that the cleaning composition is substantially non-irritating and/or non-stinging to the consumer when sprayed from the spray dispenser.

14 Claims, 1 Drawing Sheet

Coloured Stain Removal Performance

(51) Int. Cl.

| | |
|---|---|
| ***C11D 1/75*** | (2006.01) |
| ***C11D 1/83*** | (2006.01) |
| ***C11D 3/10*** | (2006.01) |
| ***C11D 3/30*** | (2006.01) |
| ***C11D 3/43*** | (2006.01) |
| ***B08B 3/04*** | (2006.01) |
| ***C11D 17/04*** | (2006.01) |
| ***C11D 1/12*** | (2006.01) |
| ***C11D 1/94*** | (2006.01) |
| ***C11D 1/14*** | (2006.01) |
| ***C11D 11/00*** | (2006.01) |
| ***C11D 3/33*** | (2006.01) |

(52) U.S. Cl.
CPC ..... *C11D 1/75* (2013.01); *C11D 1/94* (2013.01); *C11D 3/10* (2013.01); *C11D 3/30* (2013.01); *C11D 3/33* (2013.01); *C11D 11/0023* (2013.01); *C11D 17/041* (2013.01); *C11D 1/29* (2013.01)

(58) Field of Classification Search
CPC ..... C11D 3/2068; C11D 3/30; C11D 3/43; C11D 17/041; B08B 3/04
See application file for complete search history.

(56) References Cited

U.S. PATENT DOCUMENTS

| | | | | |
|---|---|---|---|---|
| 6,057,279 | A * | 5/2000 | Mertens | C11D 1/72 510/365 |
| 6,184,188 | B1 | 2/2001 | Severns | |
| 6,509,306 | B1 | 1/2003 | Wisniewski | |
| 6,683,036 | B2 | 1/2004 | Foley | |
| 6,696,399 | B1 | 2/2004 | Chernin | |
| 8,901,058 | B2 | 12/2014 | Evers | |
| 9,944,888 | B2 | 4/2018 | Gonzales | |
| 10,138,446 | B2 | 11/2018 | Boers | |
| 10,150,937 | B2 | 12/2018 | Boers | |
| 10,233,411 | B2 | 3/2019 | Hoefte | |
| 10,689,596 | B2 | 6/2020 | Boers | |
| 2005/0233925 | A1 | 10/2005 | Foley | |
| 2009/0197790 | A1 | 8/2009 | Sengupta | |
| 2010/0197553 | A1 | 8/2010 | Barnabas | |
| 2011/0105377 | A1* | 5/2011 | Yianakopoulos | C11D 1/72 510/365 |
| 2011/0180100 | A1* | 7/2011 | Hafer | C11D 3/30 134/6 |
| 2011/0226293 | A1* | 9/2011 | Bonnechere | C11D 3/044 134/198 |
| 2012/0102668 | A1 | 5/2012 | De Leersnyder | |
| 2015/0307817 | A1 | 10/2015 | Peitersen | |
| 2017/0015940 | A1 | 1/2017 | Boers | |
| 2017/0015946 | A1 | 1/2017 | Dkidak | |
| 2017/0015961 | A1 | 1/2017 | Boers | |
| 2017/0121655 | A1* | 5/2017 | Delplancke | A47L 15/4278 |
| 2017/0137745 | A1* | 5/2017 | Tang | C11D 1/146 |
| 2017/0145357 | A1 | 5/2017 | Gonzales | |
| 2017/0145358 | A1 | 5/2017 | Delplancke | |
| 2018/0201879 | A1 | 7/2018 | Gonzales | |
| 2018/0362900 | A1 | 12/2018 | Boers | |

FOREIGN PATENT DOCUMENTS

| | | | | |
|---|---|---|---|---|
| EP | 0316726 | A3 | 10/1989 | |
| EP | 0368146 | A3 | 8/1990 | |
| EP | 0616028 | A1 | 9/1994 | |
| EP | 1101816 | A3 | 8/2001 | |
| EP | 1167500 | A1 | 1/2002 | |
| EP | 3118293 | A1 | 1/2017 | |
| EP | 3118298 | * | 1/2017 | C11D 3/20 |
| EP | 3118299 | A1 | 1/2017 | |
| EP | 3118301 | A1 | 1/2017 | |
| EP | 3118295 | B1 | 10/2018 | |
| EP | 3162881 | B1 | 1/2019 | |
| JP | 2004161940 | A | 6/2004 | |
| JP | 2011153233 | A | 8/2011 | |
| JP | 2015145445 | A | 8/2015 | |
| JP | 2017110157 | A | 6/2017 | |
| WO | 9700930 | A1 | 1/1997 | |
| WO | 9715649 | A1 | 5/1997 | |
| WO | 9743375 | A1 | 11/1997 | |
| WO | WO9919441 | A1 | 4/1999 | |
| WO | 0155497 | A1 | 8/2001 | |
| WO | 03027218 | A1 | 4/2003 | |
| WO | 2004020565 | A1 | 3/2004 | |
| WO | 2007082685 | A1 | 7/2007 | |
| WO | 2007095999 | A1 | 8/2007 | |
| WO | 2008036559 | A2 | 3/2008 | |

OTHER PUBLICATIONS

All Office Actions for U.S. Appl. No. 16/010,773.
All Office Actions for U.S. Appl. No. 16/010,788.
All Office Actions for U.S. Appl. No. 16/010,797.
All Office Actions; U.S. Appl. No. 16/010,808.
Extended European Search Report and Search Opinion; Application No. 17177275.9; dated Dec. 11, 2017; 7 pages.
Extended European Search Report and Written Opinion; Application No. 18153117.9; dated May 2, 2018; 5 pages.
Third Party Opposition filed for European Patent Application Ser. No. 18153117.9, dated May 12, 2020, 15 pages.
Third Party Opposition filed for European Patent Application Ser. No. 18153117.9, dated Jun. 2, 2020, 13 pages.

* cited by examiner

| Inventive Composition 1 | Comparative Composition 1 |
| --- | --- |
| 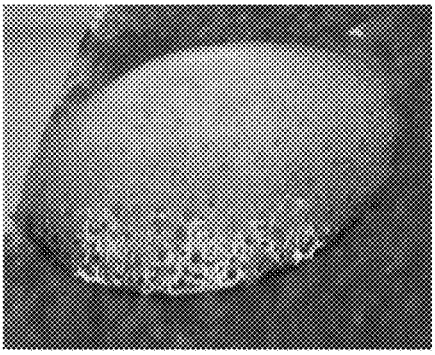 | 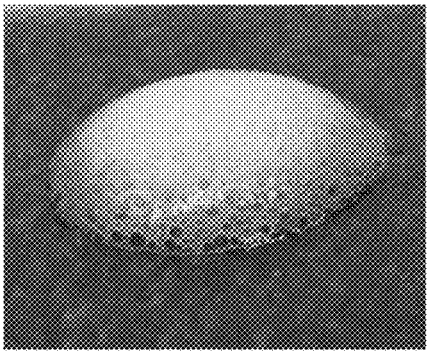 |
| Comparative Composition 2 | Comparative Composition 3 |
| 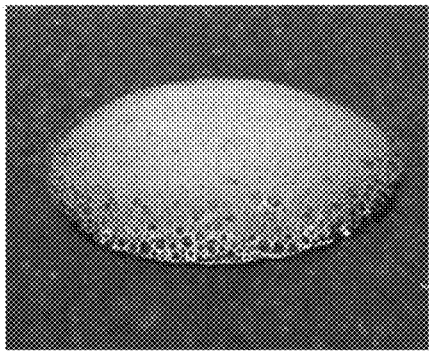 | 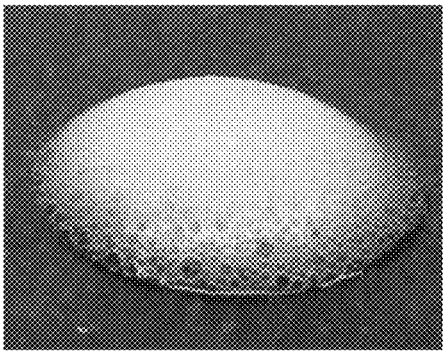 |
Coloured Stain Removal Performance

CLEANING PRODUCT

FIELD OF INVENTION

The present invention relates to a cleaning product. In particular, it relates to a cleaning product comprising a spray dispenser and a cleaning composition. More specifically, the invention relates to cleaning compositions for use in hand dishwashing.

BACKGROUND OF THE INVENTION

Traditionally, manual/hand dishwashing has been performed by filling a sink with water, adding a dishwashing detergent to create a soapy solution, immersing the soiled dishware in the solution, scrubbing the dishware and rinsing to remove the remaining soils and generated suds. This method typically involves washing an entire load of soiled dishware in one go.

Nowadays, some users prefer to clean dishware as soon as they have finished with them rather than wait until they have a full load. This method involves washing one article or a small number of articles at a time. It is usually performed under running water with a cleaning implement (e.g., sponge), whereby the user delivers detergent to the sponge. A challenge with this method is that when the number of items to be cleaned is small, there is the risk of overdosing with the detergent. As a result, it will require the need for more rinsing of the dishware and the cleaning implement. Another disadvantage associated with this method, is that some time is required to allow for the proper mixing of the detergent with the water in the sponge, and this can slow down the cleaning process.

Finding more efficient ways of cleaning dishware with this method is desirable. For example, direct application of a spray dishwashing detergent onto the soiled dishware is one such way for quicker cleaning. Spray products are well liked by consumers since they allow for direct and controlled application of the products during the dishwashing process to mitigate against the challenges mentioned above. However, a notable problem with spray dishwashing detergent is product bounce back from surfaces when spraying, which can lead to irritation/stinging to the skin, eyes, nose and/or throat of the consumers. Another problem with spray dishwashing detergent is product overspray. By "overspray" means small particles spreading to the surrounding atmosphere upon spraying. Accordingly, such bounce back or overspray may result in wasted product and/or possible product inhalation risks to the consumers.

Additionally, the level and type of soils found on dishware varies considerably depending on the use of the dishware. Dishware can be lightly soiled or heavily soiled (i.e., have hard to remove soils such as baked-, cooked- and/or burnt-on soils). When the cleaning of a lightly soiled article is done under running water, it is desirable that the cleaning is performed quickly and with minimum scrubbing effort. Ideally, the product should be applied and then immediately rinsed obviating or reducing the need for scrubbing. When articles are heavily soiled, it is desirable that the product facilitates the cleaning task by softening the well-attached soils. It is desirable that the softening takes place in a short time. In cases in which the soils are really tough it is common practice to soak the items before cleaning. The soaking time should be short.

Thus, the need remains for a cleaning composition suitable for spraying and foaming that provides good cleaning, in particular good cleaning of lightly and/or heavily soiled dishware. In particular, the cleaning composition for use in hand dishwashing should be easy to spray/foam, deliver fast and long lasting suds, and is easy to rinse. The need also exists for a cleaning composition that when sprayed onto the dishware minimizes the negatives associated with product bounce back from surfaces when sprayed and/or product overspray. It is desirable that the cleaning composition of the present invention facilitates cleaning, especially the manual dishwashing task, in particular by reducing the time and scrubbing effort needed to achieve the cleaning.

SUMMARY OF THE INVENTION

According to an aspect of the invention, there is provided a cleaning product. The cleaning product is suitable for the cleaning of any kind of surfaces but preferably the product is a hand dishwashing cleaning product. The cleaning product comprises a spray dispenser and a cleaning composition. The cleaning composition is a foaming composition and it is suitable for spraying. The cleaning composition is housed in the spray dispenser. The "cleaning composition" or "composition" of the cleaning product of the invention is herein sometimes referred to as "the composition of the invention". The cleaning composition of the invention comprises:

i) from 7% to 12% by weight of the composition of a surfactant system, wherein the surfactant system comprises an anionic surfactant and a co-surfactant, wherein the co-surfactant is selected from the group consisting of amphoteric surfactant, zwitterionic surfactant and mixtures thereof, preferably an amphoteric surfactant; and ii) from 1% to 15%, preferably from 1.5% to 10%, more preferably from 2% to 8%, most preferably from 3% to 7% by weight of the composition of a linear or branched low cut alcohol alkoxylate non-ionic surfactant with an average alkyl carbon chain length of C10 and below, preferably a low cut alcohol ethoxylate non-ionic surfactant or a mixture thereof, and comprising on average from 3 to 7 alkoxy preferably ethoxy (EO) groups, more preferably a linear C6 alcohol ethoxylate non-ionic surfactant comprising on average from 3 to 7 EO, preferably from 4 to 6 EO, more preferably 5 EO;

wherein the surfactant system described under i) excludes the low cut alcohol alkoxylate non-ionic surfactant described under ii); and wherein the surfactant system and the low cut alcohol alkoxylate non-ionic surfactant are in a weight ratio of from 5:1 to 1:5, preferably from 5:1 to 1:1, more preferably from 3:1 to 1:1.

In another aspect, the invention is directed to a method of cleaning soiled dishware using the cleaning product according to the claims, the method comprising the steps of:

a) optionally, pre-wetting the soiled dishware;

b) spraying the cleaning composition onto the soiled dishware;

c) optionally, adding water to the soiled dishware during a period of time, preferably for a period of 1 second to 30 seconds;

d) optionally, scrubbing the dishware; and e) rinsing the dishware;

preferably the method is for the removal of lightly soiled and/or heavily soiled dishware, preferably lightly soiled dishware.

In another aspect, the invention is directed to the use of a cleaning product according to the present invention, to substantially reduce stinging and/or irritation of a cleaning composition suitable for spraying and foaming.

It is an object of the invention that the cleaning composition provides very good cleaning, including the cleaning of lightly soiled and/or heavily soiled dishware, preferably lightly soiled dishware.

It is an object of the invention that the cleaning composition provides very fast cleaning, thus requiring reduced scrubbing efforts by the consumer. Accordingly, the cleaning product of the invention is especially suitable for cleaning dishware under the tap. When the dishware is only lightly soiled the composition of the invention provides very good cleaning with reduced scrubbing or in the absence of scrubbing. The dishware can be cleaned by simply spraying the composition followed by a rinse with water, optionally aided by a low force wiping action.

In the case of heavily soiled dishware the cleaning product of the invention is very good to facilitate the removal of the soil when the product is used to pre-treat the dishware. Pre-treatment usually involves leaving the soiled dishware with the neat product.

It is an object of the invention that the sprayed cleaning composition is substantially non-stinging and/or substantially non-irritating to the user when sprayed from the spray dispenser.

These and other features, aspects and advantages of the present invention will become evident to those skilled in the art from the detailed description which follows.

BRIEF DESCRIPTION OF THE DRAWINGS

While the specification concludes with claims particularly pointing out and distinctly claiming the invention, it is believed that the invention will be better understood from the following description of the accompanying figures in which like reference numerals identify like elements, and wherein:

FIG. 1 shows the results of the coloured stain removal test from Example 1a for Inventive Composition 1 and Comparative Compositions 1 to 3.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "grease" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "spray dispenser" as used herein means a container comprising a housing to accommodate the composition and means to spray that composition. Preferably, the spraying means being a trigger spray.

The term "stinging" as used herein means the burning or stinging sensation on the skin, or in the eyes, nose or throat resulting from the user coming in contact with a sprayed or atomized cleaning composition.

The term "substantially non-irritating" as used herein refers to a cleaning composition that does not induce significant itching sensation on the skin, or in the eyes, nose or throat of the user upon contact with a sprayed or atomized composition. For example, the term refers to cleaning compositions that are relatively non-lacrimating (i.e., non-tearing, tear-free).

The term "substantially non-stinging" as used herein refers to a cleaning composition that will not result in a significant stinging sensation by the user upon contact with a sprayed or atomized composition, and can be characterized by having a stinging potential value of maximum 2, preferably maximum 1, as determined by the method described herein. The term "substantially reduce or prevent" as used herein means that the components of the cleaning composition (partially) mitigate, e.g., reduce the stinging sensation on the skin, or in the eyes, nose or throat of the user.

It is understood that the test methods that are disclosed in the Test Methods Section of the present application must be used to determine the respective values of the parameters of Applicants' inventions as described and claimed herein.

In all aspects of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Product

The cleaning product of the invention includes a cleaning composition suitable for spraying from a spray dispenser to form a direct-application cleaning composition on the surface of the dishware to which it is applied. Preferably, the composition forms a foam on the surface to which it is applied without requiring additional physical (e.g., manual rubbing), chemical or like interventions. Preferably, the spray dispenser is non-solvent propellant pressurized and the spray means are of the trigger dispensing type. The spray dispenser can be a pre-compression sprayer or an aerosol spray with a pressure control valve, both commercially available in the art. Suitable pre-compression sprayers in which a buffer mechanism to control the maximum pressure can be added include the Flairosol® spray dispenser, manufactured and sold by Afa Dispensing Group (The Netherlands) and the pre-compression trigger sprayers described in U.S. Patent Publication Nos. 2013/0112766 and 2012/0048959.

The Applicants have surprisingly discovered a new way of formulating sprayable cleaning compositions to provide good and fast cleaning, including good cleaning of light and/or tough soils, and particularly suitable when spraying the composition to clean dishware. Foaming is a property that users associate with cleaning. Therefore, it is important that the cleaning composition of the invention foams to send the user the signal that the composition is cleaning.

The Applicants have also surprisingly discovered that sprayable cleaning compositions containing high surfactant levels and high organic grease cleaning solvent levels can cause irritation and/or stinging to the users from product bounce back from surfaces when sprayed and/or product overspray. Without wishing to be bound by theory, it is believed that the introduction of high surfactant levels decreases the surface tension and hence the spray particle sizes. As a result, the high surfactant level facilitates aerosolization and product bounce back from hard surfaces and product overspray creates the risk of product inhalation by the consumer. When formulating organic solvents, especially organic solvents with limited water solubility, it is believed that individual solvent molecules will form solvation spheres and will be separating out from the water phase within these sprayed particles upon contact with the skin, causing local irritation/stinging accordingly. The Applicants surprisingly found that the low cut alcohol alkoxylate non-ionic surfactant according to the invention, reduces the stinging risk of a sprayable composition compared to organic grease cleaning solvents, while still cleaning organic soils, especially coloured organic soils. It is believed that the mixed surfactant solvent properties from the low cut alcohol alkoxylate non-ionic surfactant according to the invention still enables coloured soil extraction while keeping the compounds sufficiently dissolved to prevent local solvent sphere formation. Furthermore, lightly soluble organic grease cleaning solvents have also been found to negatively impact the physical stability profile (i.e., phase splitting upon storage) of the cleaning composition. Addition of the low cut alcohol alkoxylate non-ionic surfactant according to the invention has been found to also improve the physical stability profile of compositions, likely again due to their mixed surfactant solvent properties.

The cleaning composition is preferably a hand dishwashing cleaning composition, preferably in liquid form.

Specifically, in one aspect, the compositions of the invention have a surfactant system comprising an anionic surfactant and at least one further co-surfactant that have been found to be very good from a cleaning and sudsing view point. They have also been found very good from a spray pattern view point and are substantially non-stinging and/or substantially non-irritating to the users when sprayed. For example, the presence of small droplets (and therefore the risk of inhalation) is minimized when the surfactant system of the composition of the invention comprises anionic surfactant and a co-surfactant. By "co-surfactant" as used herein means a surfactant that is not an anionic surfactant nor a low alcohol alkoxylate non-ionic surfactant. Preferably the co-surfactant is selected from amphoteric and/or zwitterionic surfactants, preferably amine oxide and/or betaine surfactants, most preferably amine oxide surfactants.

Preferably, the composition comprises the surfactant system and the low cut alcohol alkoxylate non-ionic surfactant present in a weight ratio of from 5:1 to 1:5, preferably 5:1 to 1:1, more preferably from 3:1 to 1:1. Without wishing to be bound by theory, it is believed that the surfactant system seems to help with the cleaning and foam generation and the low cut alcohol alkoxylate non-ionic surfactant seems to help with the speed of cleaning and with foam generation and stabilization, while not causing stinging.

Preferably, the anionic surfactant is a sulfate surfactant or an alkyl sulfosuccinate. Preferred sulfate surfactants are an alkyl ethoxylate sulfate surfactant or a branched short chain alkyl sulfate surfactant. It has been found that alkyl ethoxylated sulfate with an average degree of ethoxylation from about 2 to about 5, more preferably about 3, performs better in terms of cleaning and speed of cleaning than other ethoxylate alkyl sulfate surfactants with a lower degree of ethoxylation. When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the moles of sulfate anionic surfactant components not having alkoxylate groups should also be included.

$$\text{Mol average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

By a "branched short chain alkyl sulfate surfactant" is herein meant a surfactant having a linear alkyl sulfate backbone, the backbone comprising from 4 to 8, preferably from 5 to 7 carbon atoms, substituted with one or more C1-C5 preferably C1-C3 alkyl branching groups in the C1, C2 or C3, preferably C2 position on the linear alkyl sulfate backbone. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention. The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived. Preferred branched short chain alkyl sulfate for use herein is a branched hexyl sulfate, more preferably 2-ethyl hexyl sulphate and mixtures thereof. The preferred alkyl sulfosuccinate herein is 2-ethylhexylsulfosuccinate.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, are the weight in grams of each alcohol in the total alcohol mixture of the alcohols which were used as starting material for the anionic surfactant for the detergent of the invention.

In the weight average branching degree calculation, the weight of anionic surfactant components not having branched groups should also be included. When the surfactant system comprises a branched anionic surfactant, the surfactant system comprises at least 50%, more preferably at least 60% and preferably at least 70% of branched anionic surfactant by weight of the surfactant system, more preferably the branched anionic surfactant comprises more than 50% by weight thereof of an alkyl ethoxylated sulfate having an average ethoxylation degree of from about 2 to about 5 and preferably a level of branching of from 5% to 40%.

Suitable sulfate surfactants for use herein include water-soluble salts of C8-C18 alkyl, preferably C8-C18 alkyl comprising more than 50% by weight of the C8 to C18 alkyl of C12 to C14 alkyl or hydroxyalkyl, sulfate and/or ether sulfate. Suitable counterions include alkali metal cation earth alkali metal cation, alkanolammonium or ammonium or substituted ammonium, but preferably sodium.

The sulfate surfactants may be selected from C8-C18 alkyl alkoxy sulfates (AExS) wherein preferably x is from 1-30 in which the alkoxy group could be selected from ethoxy, propoxy, butoxy or even higher alkoxy groups and mixtures thereof. Especially preferred for use herein is alkyl ethoxy sulfate with an average alkyl carbon chain length of C12 to C14 and an average degree of ethoxylation from 2 to 5, preferably 3.

Alkyl alkoxy sulfates are commercially available with a variety of chain lengths, ethoxylation and branching degrees. Commercially available sulfates include, those based on Neodol® alcohols ex the Shell company, Lial-Isalchem® and Safol® ex the Sasol company, natural alcohols ex The Procter & Gamble Chemicals company.

Preferably, the at least one further co-surfactant is selected from the group consisting of amphoteric surfactant, zwitterionic surfactant and mixtures thereof. Preferably, the at least one further co-surfactant is selected from betaine preferably cocoamidopropylbetaine, sulfobetaine (INCI Sultaines) preferably laurylhydroxysulfobetaine, amine oxide or mixtures thereof. Amine oxide is the preferred further co-surfactant for use herein. The amine oxide surfactant is preferably linear or branched alkyl amine oxide, linear or branched alkyl amidopropyl amine oxide, and mixtures thereof, preferably linear alkyl dimethyl amine oxide, more preferably linear C10 alkyl dimethyl amine oxide, linear C12-C14 alkyl dimethyl amine oxides and mixtures thereof, most preferably C12-C14 alkyl dimethyl amine oxide. The at least one further co-surfactant seems to help with the sudsing of the product. Particularly good performing products are those in which the anionic surfactant and the at least one further co-surfactant are present in a weight ratio of 5:1 to 1:5 preferably of 3:1 to 1:1. When the anionic surfactant comprises an alkoxylated alkyl sulphate the preferred anionic surfactant: the at least one further co-surfactant weight ratio is from 3:1 to 2:1. When the anionic surfactant comprises a short chain branched alkyl sulphate surfactant the preferred anionic surfactant: the at least one further co-surfactant the weight ratio is from 2:1 to 1:1. Especially preferred are compositions in which the further co-surfactant comprises amine oxide. The anionic surfactant of the invention has been found to deliver strong grease cleaning as well as good foaming performance, especially immediate foaming performance upon spraying when the composition comprises amine oxide or betaine as co-surfactant, preferably amine oxide as co-surfactant.

The composition according to the invention also comprises from 1% to 15%, preferably from 1.5% to 10%, more preferably from 2% to 8%, most preferably from 3% to 7% by weight of the composition of a non-ionic surfactant selected from low cut alcohol alkoxylate non-ionic surfactant, preferably low cut alcohol ethoxylate surfactant or mixtures thereof, more preferably a C6 alcohol ethoxylate surfactant, preferably comprising on average from 1 to 10 EO, preferably from 3 to 8, preferably from 4 to 6, most preferably 5. Low cut alcohol ethoxylate surfactants include alcohol ethoxylate surfactants with an average alkyl carbon chain length of C10 and below. The alkyl chain can be linear or branched and originating from a natural or synthetically derived alcohol. Suitable non-ionic alcohol ethoxylate surfactants include commercially available materials such as Emulan® HE50 or Lutensol® CS6250 (available from BASF).

The composition preferably further comprises from 0.01% to 5%, preferably from 0.03% to 3%, more preferably from 0.05% to 1%, most preferably from 0.07% to 0.5% by weight of the composition of a thickening agent, preferably the thickening agent is selected from the group consisting of polyethylene glycol, polyalkylene oxide, polyvinyl alcohol, polysaccharide and mixtures thereof, preferably polysaccharides, preferably xanthan gum. Without wishing to be bound by theory, these thickening agents are believed to further reduce stinging and/or enable stronger clinging of the composition to surfaces, especially to vertically positioned surfaces.

The composition of the invention can further comprise: i) a glycol ether solvent. Preferably, 1% to 8%, preferably from 2% to 7% by weight of the composition of a glycol ether solvent selected from the group consisting of glycol ethers of:

a) Formula (I): R1O(R2O)nR3, wherein R1 is a linear or branched C4, C5 or C6 alkyl or a substituted or unsubstituted phenyl; R2 is ethyl or isopropyl; R3 is hydrogen or methyl; and n is 1, 2 or 3; and mixtures thereof;

b) Formula (II): R4O(R5O)nR6, wherein: R4 is n-propyl or isopropyl; R5 is isopropyl; R6 is hydrogen or methyl; and n is 1, 2 or 3; and c) mixtures thereof.

The glycol ether of the product of the invention can boost foaming. Suitable glycol ether solvents according to Formula (I) include ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, ethyleneglycol n-pentyl ether, diethyleneglycol n-pentyl ether, triethyleneglycol n-pentyl ether, propyleneglycol n-pentyl ether, dipropyleneglycol n-pentyl ether, tripropyleneglycol n-pentyl ether, ethyleneglycol n-hexyl ether, diethyleneglycol n-hexyl ether, triethyleneglycol n-hexyl ether, propyleneglycol n-hexyl ether, dipropyleneglycol n-hexyl ether, tripropyleneglycol n-hexyl ether, ethyleneglycol phenyl ether, diethyleneglycol phenyl ether, triethyleneglycol phenyl ether, propyleneglycol phenyl ether, dipropyleneglycol phenyl ether, tripropyleneglycol phenyl ether, ethyleneglycol benzyl ether, diethyleneglycol benzyl ether, triethyleneglycol benzyl ether, propyleneglycol benzyl ether, dipropyleneglycol benzyl ether, tripropyleneglycol benzyl ether, ethyleneglycol isobutyl ether, diethyleneglycol isobutyl ether, triethyleneglycol isobutyl ether, propyleneglycol isobutyl ether, dipropyleneglycol isobutyl ether, tripropyleneglycol isobutyl ether, ethyleneglycol isopentyl ether, diethyleneglycol isopentyl ether, triethyleneglycol isopentyl ether, propyleneglycol isopentyl ether, dipropyleneglycol isopentyl ether, tripropyleneglycol isopentyl ether, ethyleneglycol isohexyl ether, diethyleneglycol isohexyl ether, triethyleneglycol isohexyl ether, propyleneglycol isohexyl ether, dipropyleneglycol isohexyl ether, tripropyleneglycol isohexyl ether, ethyleneglycol n-butyl methyl ether, diethyleneglycol n-butyl methyl ether triethyleneglycol n-butyl methyl ether, propyleneglycol n-butyl methyl ether, dipropyleneglycol n-butyl methyl ether, tripropyleneglycol n-butyl methyl ether, ethyleneglycol n-pentyl methyl ether, diethyleneglycol n-pentyl methyl ether, triethyleneglycol n-pentyl methyl ether, propyleneglycol n-pentyl methyl ether, dipropyleneglycol n-pentyl methyl ether, tripropyleneglycol n-pentyl methyl ether, ethyleneglycol n-hexyl methyl ether, diethyleneglycol n-hexyl methyl ether, triethyleneglycol n-hexyl methyl ether, propyleneglycol n-hexyl methyl ether, dipropyleneglycol n-hexyl methyl ether, tripropyleneglycol n-hexyl methyl ether, ethyleneglycol phenyl methyl ether, diethyleneglycol phenyl methyl ether, triethyleneglycol phenyl methyl ether, propyleneglycol phenyl methyl ether, dipropyleneglycol phenyl methyl ether, tripropyleneglycol phenyl methyl ether, ethyleneglycol benzyl methyl ether, diethyleneglycol benzyl methyl ether, triethyleneglycol benzyl methyl ether, propyleneglycol benzyl methyl ether, dipropyleneglycol benzyl methyl ether, tripropyleneglycol benzyl methyl ether, ethyleneglycol isobutyl methyl ether, diethyleneglycol isobutyl methyl ether, triethyleneglycol isobutyl methyl ether, propyleneglycol isobutyl methyl ether, dipropyleneglycol isobutyl methyl ether, tripropyleneglycol isobutyl methyl ether, ethyleneglycol isopentyl methyl ether, diethyleneglycol isopentyl methyl ether, triethyleneglycol isopentyl methyl ether, propyleneglycol isopentyl methyl ether, dipropyleneglycol isopentyl methyl ether, tripropyleneglycol isopentyl methyl ether, ethyleneglycol isohexyl methyl ether, diethyleneglycol isohexyl methyl ether, triethyleneglycol isohexyl methyl ether, propyleneglycol isohexyl methyl ether, dipropyleneglycol isohexyl methyl ether, tripropyleneglycol isohexyl methyl ether, and mixtures thereof.

Preferred glycol ether solvents according to Formula (I) are ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, and mixtures thereof.

Most preferred glycol ethers according to Formula (I) are propyleneglycol n-butyl ether, dipropyleneglycol n-butyl ether, and mixtures thereof.

Suitable glycol ether solvents according to Formula (II) include propyleneglycol n-propyl ether, dipropyleneglycol n-propyl ether, tripropyleneglycol n-propyl ether, propyleneglycol isopropyl ether, dipropyleneglycol isopropyl ether, tripropyleneglycol isopropyl ether, propyleneglycol n-propyl methyl ether, dipropyleneglycol n-propyl methyl ether, tripropyleneglycol n-propyl methyl ether, propyleneglycol isopropyl methyl ether, dipropyleneglycol isopropyl methyl ether, tripropyleneglycol isopropyl methyl ether, and mixtures thereof.

Preferred glycol ether solvents according to Formula (II) are propyleneglycol n-propyl ether, dipropyleneglycol n-propyl ether, and mixtures thereof.

Most preferred glycol ether solvents are propyleneglycol n-butyl ether, dipropyleneglycol n-butyl ether, and mixtures thereof, especially dipropyleneglycol n-butyl ether.

Suitable glycol ether solvents can be purchased from The Dow Chemical Company, more particularly from the E-series (ethylene glycol based) Glycol Ethers and the P-series (propylene glycol based) Glycol Ethers line-ups. Suitable glycol ether solvents include Butyl Carbitol™, Hexyl Carbitol™, Butyl Cellosolve™, Hexyl Cellosolve™, Butoxytriglycol, Dowanol™ Eph, Dowanol™ PnP, Dowanol DPnP™, Dowanol™ PnB, Dowanol™ DPnB, Dowanol™ TPnB, Dowanol™ PPh, and mixtures thereof.

The composition of the invention can further comprise: ii) an ester solvent. Preferably from 0.1% to 15%, preferably from 2 to 10%, more preferably from 2 to 8%, even more preferably from 3 to 7%, most preferably from 4 to 6% by weight of the composition of an ester solvent selected from the group consisting of:

a) monoesters having the Formula (III): R1C═OOR2, wherein: R1 is a linear or branched C1 to C4 alkyl, preferably a linear or branched C2 to C3 alkyl; and R2 is a linear or branched C2 to C8 alkyl, preferably a linear or branched C2 to C6 alkyl, most preferably a linear of branched C3 to C4 alkyl;

b) di- or tri-esters having the Formula (IV): R1(C═OOR2)n, wherein: R1 is a saturated or unsaturated C2 to C4 alkyl; R2 is independently selected from a linear or branched C2 to C8 alkyl, preferably a linear or branched C2 to C6 alkyl, most preferably a linear of branched C3 to C4 alkyl; and n is 2 or 3 preferably 2;

c) benzylbenzoate; and d) mixtures thereof.

An ester solvent is defined as an organic solvent comprising an ester functional group. Suitable monoesters include but are not limited to ethylacetate, propylacetate, isopropylacetate, butylacetate, isobutylacetate, amylacetate, isoamylacetate, hexylacetate, isohexylacetate, heptylacetate, isoheptylacetate, octylacetate, isooctylacetate, 2-ethylhexylacetate, ethylpropionate, propylpropionate, isopropylpropionate, butylpropionate, isobutylpropionate, amylpropionate, isoamylpropionate, hexylpropionate, isohexylpropionate, heptylpropionate, isoheptylpropionate, octylpropionate, isooctylpropionate, 2-ethylhexylpropionate, ethylbutyrate, propylbutyrate, isopropylbutyrate, butylbutyrate, isobutylbutyrate, amylbutyrate, isoamylbutyrate, hexylbutyrate, isohexylbutyrate, heptylbutyrate, isoheptylbutyrate, octylbutyrate, isooctylbutyrate, 2-ethylhexylbutyrate, ethylisobutyrate, propylisobutyrate, isopropylisobutyrate, butylisobutyrate, isobutylisobutyrate, amylisobutyrate, isoamylisobutyrate, hexylisobutyrate, isohexylisobutyrate, heptylisobutyrate, isoheptylisobutyrate, octylisobutyrate, isooctylisobutyrate, 2-ethylhexylisobutyrate, ethylpentanoate, propylpentanoate, isopropylpentanoate, butylpentanoate, isobutylpentanoate, amylpentanoate, isoamylpentanoate, hexylpentanoate, isohexylpentanoate, heptylpentanoate, isoheptylpentanoate, octylpentanoate, isooctylpentanoate, 2-ethylhexylpentanoate, ethylisopentanoate, propylisopentanoate, isopropylisopentanoate, butylisopentanoate, isobutylisopentanoate, amylisopentanoate, isoamylisopentanoate, hexylisopentanoate, isohexylisopentanoate, heptylisopentanoate, isoheptylisopentanoate, octylisopentanoate, isooctylisopentanoate, 2-ethylhexylisopentanoate, and mixtures thereof.

Preferably the monoesters are selected from the group consisting of ethylpropionate, propylpropionate, isopropylpropionate, butylpropionate, isobutylpropionate, amylpropionate, isoamylpropionate, hexylpropionate, isohexylpropionate, ethylbutyrate, propylbutyrate, isopropylbutyrate, butylbutyrate, isobutylbutyrate, amylbutyrate, isoamylbutyrate, hexylbutyrate, isohexylbutyrate, ethylisobutyrate, propylisobutyrate, isopropylisobutyrate, butylisobutyrate, isobutylisobutyrate, amylisobutyrate, isoamylisobutyrate, hexylisobutyrate, isohexylisobutyrate, and mixtures thereof.

Most preferably the monoesters are selected from the group consisting of propylpropionate, isopropylpropionate, butylpropionate, isobutylpropionate, propylbutyrate, isopropylbutyrate, butylbutyrate, isobutylbutyrate, propylisobutyrate, isopropylisobutyrate, butylisobutyrate, isobutylisobutyrate, and mixtures thereof.

Suitable di- or tri-esters include but are not limited to ethyl-, propyl-, isopropyl-, butyl-, isobutyl-, amyl-, isoamyl-, hexyl-, isohexyl-, heptyl-, isoheptyl, octyl-, isooctyl-, 2-ethylhexy-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

Preferably di- or tri-esters are selected from the group consisting of ethyl-, propyl-, isopropyl-, butyl-, isobutyl-, amyl-, isoamyl-, hexyl-, isohexyl-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

More preferably di- or tri-esters are selected from the group consisting of ethyl-, propyl-, isopropyl-, butyl-, isobutyl-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

Another suitable ester solvent is benzylbenzoate.

The composition of the invention can further comprise: iii) from 0.1 to 10%, preferably from 1 to 9%, more preferably from 2 to 8%, most preferably from 4 to 6% by weight of the composition of an alcohol solvent selected from the group consisting of C4-C6 linear mono-alcohols, branched C4-C10 mono-alcohols having one or more C1-C4 branching groups, alkyl mono-glycerols, and mixtures thereof. The alcohol of the product of the invention can boost foaming.

Preferred C4-C6 linear mono-alcohols are selected from pentanol, hexanol, and mixtures thereof, preferably 1-pentanol, 1-hexanol, and mixtures thereof.

Preferred branched C4-C10 mono-alcohols having one or more C1-C4 branching groups for use herein are C4-C8 primary mono-alcohols having one or more C1-C4 branching groups, and mixtures thereof. Especially preferred branched C4-C10 mono-alcohols having one or more C1-C4 branching groups for use herein include methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol and trimethyl nonanol, and mixtures thereof. More preferred for use herein are the primary 1-alcohol member of branched C4-C10 mono-alcohols having one or more C1-C4 branching groups, especially preferred are the primary 1-alcohol family members of methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol, and mixtures thereof.

More preferred alcohols are butyl octanol, trimethyl hexanol, ethyl hexanol, propyl heptanol, methyl butanol, and mixtures thereof, in particular the primary 1-alcohol family member, more in particular ethyl hexanol, butyl octanol, trimethyl hexanol, and mixtures thereof, especially 2-ethyl-1-hexanol, 2-butyl-1-octanol, 3,5,5 trimethyl-1-hexanol, and mixtures thereof.

Preferred alkyl mono-glycerols are selected from the group consisting of branched alkyl mono-glycerols and mixtures thereof, more preferably branched C4-C8 alkyl mono-glycerols with one or more C1 to C4 alkyl branching groups, more preferably selected from the group consisting of ethylhexylglycerol, propylheptylglycerol, and mixtures thereof, most preferably 2-ethylhexylglycerol.

Especially preferred for use herein are mixtures of mono-alcohols, in particular mixtures comprising a branched C4-C10 mono-alcohol, more in particular mixtures comprising an alcohol selected from the group comprising C4-C8 more preferably C6-C7 branched primary alcohols. Preferably for use is a mixture of alcohols comprising an alcohol selected from the group comprising C4-C8 branched primary alcohols with an alcohol selected of the group of C4-C6 linear mono-alcohols and alkylglycerols. Mixtures can boost foaming and improve cleaning over a plurality of different oily soils.

The composition of the invention can further comprise: iv) from 0.1 to 10%, preferably from 1 to 9%, more preferably from 2 to 8%, most preferably from 4 to 6% by weight of the composition of an alcohol solvent selected from the group consisting of C1-C3 linear of branched mono alcohols, C1-C3 polyols and mixtures thereof, a glycol solvent selected from the group consisting of ethyleneglycol, propyleneglycol, polyethyleneglycol, polypropyleneglycol, and mixtures thereof. These solvents are believed to facilitate physical stabilization of the overall composition as well as controlling the finished product rheology to keep the composition suitable for spraying applications.

The composition of the invention can further comprise: v) a hydrotrope, preferably, from 0.5% to 10%, preferably from 1% to 5%, more preferably from 1.5% to 3%, most preferably from 3% to 7% by weight of the composition of a hydrotrope selected from the group consisting of sodium cumene sulphonate, sodium xylene sulphonate, sodium toluene sulphonate, and mixtures thereof, preferably sodium cumene sulphonate. Hydrotropes may also positively contribute to the physical stabilization of the overall detergent composition.

The composition of the invention can further comprise mixtures of i), ii), iii), iv), and v).

The composition of the invention may further comprises a chelant at a level of from 0.1% to 10%, preferably from 0.2% to 5%, more preferably from 0.2% to 3%, most preferably from 0.5% to 1.5% by weight of the composition. Suitable chelating agents can be selected from the group consisting of amino carboxylates, amino phosphonates, polyfunctionally-substituted aromatic chelating agents and mixtures thereof. Amino carboxylates include ethylenediaminetetraacetates, N-hydroxyethylethylenediaminetriacetates, nitrilo-triacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein, as well as methyl-glycine-diacetic acid (MGDA), and salts and derivatives thereof and glutamic-N,N-diacetic acid (GLDA) and salts and derivatives thereof. GLDA (salts and derivatives thereof) is especially preferred according to the invention, with the tetrasodium salt thereof being especially preferred. The amino carboxylate not only acts as a chelant but also contributes to the reserve alkalinity, this seems to help with the cleaning of heavily soiled dishware.

The composition herein may comprise a builder, preferably a carboxylate builder. Salts of carboxylic acids useful herein include salts of C1-6 linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred salts of carboxylic acids are those selected from the salts from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid, citric acid, and mixtures thereof, preferably citric acid.

Alternative carboxylate builders suitable for use in the composition of the invention includes salts of fatty acids like palm kernel derived fatty acids or coconut derived fatty acid, or salts of polycarboxylic acids.

The cation of the salt is preferably selected from alkali metal, alkaline earth metal, monoethanolamine, diethanolamine or triethanolamine and mixtures thereof, preferably sodium.

The carboxylic acid or salt thereof, when present, is preferably present at the level of from 0.1% to 5%, more preferably from 0.2% to 1% by weight of the total composition.

Preferably, the composition of the invention comprises bicarbonate and/or monoethanol and/or carboxylate builder preferably citrate builder, that as in the case of the aminocarboxylate chelant also contribute to the reserve alkalinity.

The composition of the invention can further comprise a cleaning amine such as a cyclic cleaning amine of Formula (V):

(V)

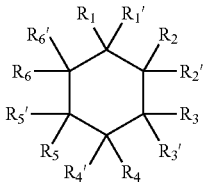

wherein two of the substituents $R_s$($R_1$-$R_6$, $R_1$'-$R_6$') are independently selected from the group consisting of NH2, (C1-C4)NH2 and mixtures thereof and the remaining substituents $R_s$ are independently selected from H, linear or branched alkyl or alkenyl having from 1 to 10 carbon atoms.

The term "cyclic diamine" herein encompasses a single cleaning amine and a mixture thereof. The amine can be subjected to protonation depending on the pH of the cleaning medium in which it is used.

The amine of Formula (V) is a cyclic amine with two primary amine functionalities. The primary amines can be in any position in the cycle but it has been found that in terms of grease cleaning, better performance can be obtained when the primary amines are in positions 1,3. It has also been found advantageous in terms of grease cleaning amines in which one of the substituents is —CH3 and the rest are H.

Preferred cyclic diamines for use herein are selected from the group consisting of:

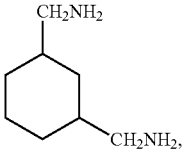

1,3-bis(methylamine)-cyclohexane

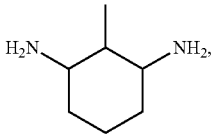

2-methylcyclohexane-1,3-diamine

-continued

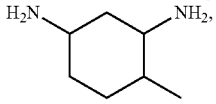

4-methylcyclohexane-1,3-diamine

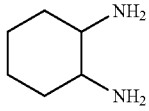

Cyclohexane-1,2-diamine

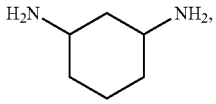

Cyclohexane-1,3-diamine

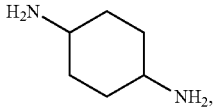

Cyclohexane-1,4-diamine

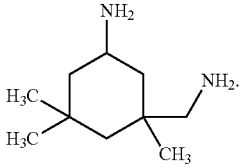

Isophorone diamine; and a mixture thereof

Especially preferred for use herein are cyclic diamines selected from the group consisting of 1,3-bis(methylamine)-cyclohexane, 2-methylcyclohexane-1,3-diamine, 4-methylcyclohexane-1,3-diamine and mixtures thereof. 1,3-bis(methylamine)-cyclohexane is especially preferred for use herein. Mixtures of 2-methylcyclohexane-1,3-diamine, 4-methylcyclohexane-1,3-diamine are also preferred for use herein.

The composition of the invention can comprise cleaning amines such as polyetheramines selected from the group consisting of polyetheramines of Formula (VI), Formula (VII), Formula (VIII) and a mixture thereof. One of the polyetheramine preferred for use in the composition of the invention is represented by the structure of Formula (VI):

(VI)

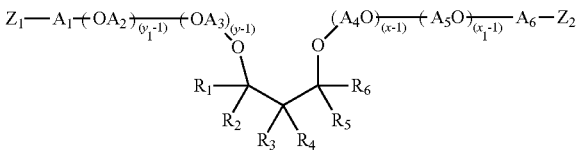

wherein each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20, more typically about 2 to about 10 or about 3 to about 8 or about 4 to about 6, where $x \geq 1$ and $y \geq 1$, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (VI), each of $A_1$-$A_6$ is independently selected from ethylene, propylene, or butylene, typically each of $A_1$-$A_6$ is propylene. More preferably, in the polyetheramine of Formula (I), each of $R_1$, $R_2$, $R_5$, and $R_6$ is H and each of $R_3$ and $R_4$ is independently selected from C1-C16 alkyl or aryl, typically each of $R_1$, $R_2$, $R_5$, and $R_6$ is H and each of $R_3$ and $R_4$ is independently selected from a butyl group, an ethyl group, a methyl group, a propyl group, or a phenyl group. More preferably, in the polyetheramine of Formula (I), $R_3$ is an ethyl group, each of $R_1$, $R_2$, $R_5$, and $R_6$ is H, and $R_4$ is a butyl group. Especially, in the polyetheramine of Formula (I), each of $R_1$ and $R_2$ is H and each of $R_3$, $R_4$, $R_5$, and $R_6$ is independently selected from an ethyl group, a methyl group, a propyl group, a butyl group, a phenyl group, or H.

Another polyetheramine preferred for use in the composition of the invention is represented by the structure of Formula (VII):

(VII)

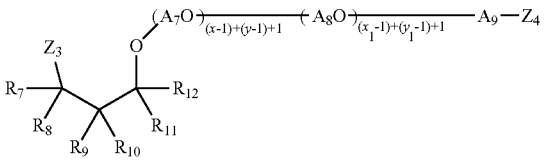

wherein each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of 2 to 200, typically 2 to 20, more typically 2 to 10 or 3 to 8 or 2 to 4, where $x \geq 1$ and $y \geq 1$, and the sum of $x_1+y_1$ is in the range of 2 to 200, typically 2 to 20, more typically 2 to 10 or 3 to 8 or 2 to 4, where $x_1 \geq 1$ and $y_1 \geq 1$.

Preferably in the polyetheramine of Formula (VII), each of $A_7$-$A_9$ is independently selected from ethylene, propylene, or butylene, typically each of $A_7$-$A_9$ is propylene. More preferably, in the polyetheramine of Formula (II), each of $R_7$, $R_8$, $R_{11}$, and $R_{12}$ is H and each of $R_9$ and $R_{10}$ is independently selected from C1-C16 alkyl or aryl, typically each of $R_7$, $R_8$, $R_{11}$, and $R_{12}$ is H and each of $R_9$ and $R_{10}$ is independently selected from a butyl group, an ethyl group, a methyl group, a propyl group, or a phenyl group. More preferably, in the polyetheramine of Formula (VII), $R_9$ is an ethyl group, each of $R_7$, $R_8$, $R_{11}$, and $R_{12}$ is H, and $R_{10}$ is a butyl group. In some aspects, in the polyetheramine of Formula (VII), each of $R_7$ and $R_8$ is H and each of $R_9$, $R_{10}$, $R_{11}$, and $R_{12}$ is independently selected from an ethyl group, a methyl group, a propyl group, a butyl group, a phenyl group, or H.

Preferred polyetheramines are selected from the group consisting of Formula A, Formula B, and mixtures thereof:

Formula A

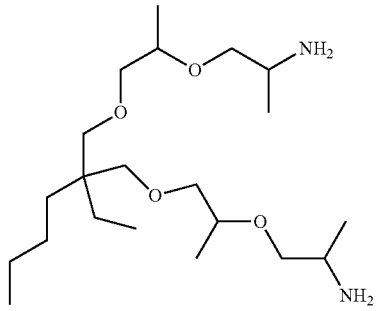

Formula B

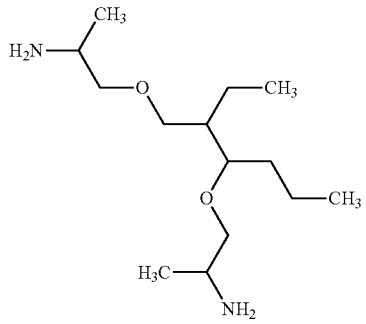

Preferably, the polyetheramine comprises a mixture of the compound of Formula (VI) and the compound of Formula (VII).

Typically, the polyetheramine of Formula (VI) or Formula (VII) has a weight average molecular weight of less than grams/mole 1000 grams/mole, preferably from 100 to 800 grams/mole, more preferably from 200 to 450 grams/mole.

Another polyetheramine preferred for use in the composition of the invention is represented by the structure of Formula (VIII):

(VIII)

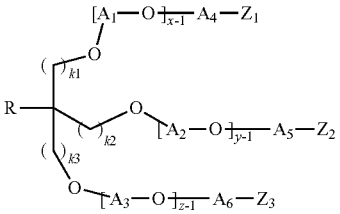

wherein R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from 2 to 18 carbon atoms or mixtures thereof, $x \geq 1$, $y \geq 1$, and $z \geq 1$, and the sum of x+y+z is in the range of from 3 to 100, each of $Z_1$, $Z_2$, and $Z_3$ is independently selected from $NH_2$ or OH, where at least two of $Z_1$, $Z_2$, and $Z_3$ are $NH_2$; and the polyetheramine has a weight average molecular weight of from 150 to 1000 grams/mole.

Other preferred cleaning amines for use herein are amines of Formula (IX), Formula (X), Formula (XI) or mixtures thereof.

The cleaning amine of Formula (IX) has an ethylene diamine core with at least one primary amine functionality. The cleaning amine also comprises at least another nitrogen atom, preferable in the form of a tertiary amine functionality.

Herein the term "core" refers to the alkyl chain between two nitrogen radicals. The number of carbons in the core does not include the radicals attached to the core. One of the cleaning amine preferred for use in the composition of the invention is represented by the structure of Formula (IX):

(IX)

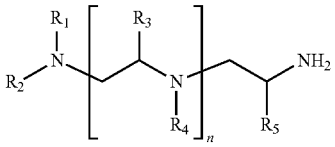

wherein: $R_1$, $R_2$, $R_3$, $R_4$, and $R_5$ are independently selected from —H, linear, branched or cyclic alkyl or alkenyl having from 1 to 10 carbon atoms and n=0-3.

Preferably, the cleaning amine is aliphatic in nature. The cleaning amine preferably has a molecular weight of less than 1000 grams/mole and more preferably less than 450 grams/mole. "n" varies from 0 to not more than 3, preferably "n" is 0. The amine molecule contains at least one primary amine functionality and preferably a tertiary amine functionality.

Suitable cleaning amines for use herein include amines wherein $R_1$ and $R_2$ are selected from isopropyl and butyl, preferably $R_1$ and $R_2$ are both isopropyl or both butyl. Preferably cleaning amines include those in which R1 and R2 are isopropyl and preferably, n is 0. Also preferred are amines in which R1 and R2 are butyl and preferably, n is 0.

Preferred cleaning amines for use herein are selected from the group consisting of:

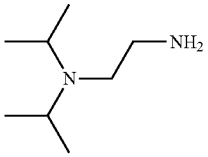

$N_1$,$N_1$-diisopropylethane-1,2-diamine

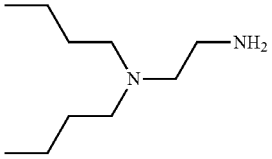

$N^1$,$N^1$-dibutylethane-1,2-diamine

R5 is preferably —CH3 or —CH2CH3. Cleaning amines in which R5 is —CH3 or —CH2CH3 could be good in terms of composition stability. Without wishing to be bound by theory, it is believed that the methyl or ethyl radical can provide stearic hinderance that protects the cleaning amine from negative interaction with other components of the cleaning composition.

Another cleaning amine preferred for use in the composition of the invention is represented by the structure of Formula (X):

(X)

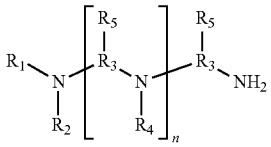

wherein $R_1$ and $R_4$ are independently selected from —H, linear, branched or cyclic alkyl or alkenyl; having from 1 to 10 carbon atoms and $R_2$ is a linear, branched or cyclic alkyl or alkenyl having from 3 to 10 carbons, $R_3$ is a linear or branched alkyl from 3 to 6 carbon atoms, $R_5$ is H, methyl or ethyl and is preferably located in alpha position from the amine functionality/ies, and n=0-3.

The cleaning amine of Formula (X) has a C3-C6 diamine core with at least one of the amine functionalities being a primary amine. Herein the term "core" refers to the alkyl chain between two nitrogen radicals. The number of carbons in the core does not include the radicals attached to the core.

The cleaning amine of Formula (X) preferably has a molecular weight of less than about 1000 grams/mole and more preferably less than about 450 grams/mole. "n" varies from 0 to not more than 3, preferably "n" is 0. The amine molecule contains at least one primary amine functionality and preferably a tertiary amine functionality.

Suitable cleaning amines include amines wherein $R_1$ and $R_2$ are selected from propyl, butyl and hexyl, preferably $R_1$ and $R_2$ are both propyl, butyl or hexyl. Preferably n is 0.

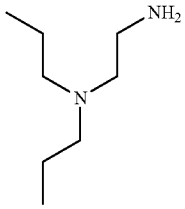

N'N'-dipropylpropane 1,3 ldiamine

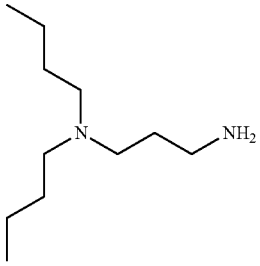

$N^1$,$N^1$-dibutylpropane-1,3-diamine

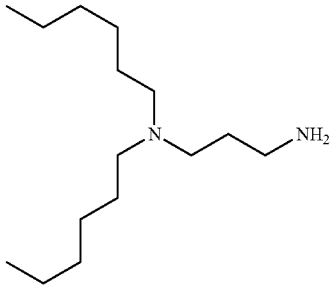

$N^1$,$N^1$-dihexylpropane-1,3-diamine

Another preferred cleaning amine for use herein is cyclohexyl propylenediamine (wherein n=0, R1 is cyclohexanyl and R2 is H).

Another cleaning amine preferred for use in the composition of the invention is represented by the structure of Formula (XI):

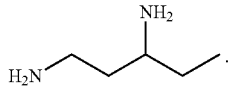

(XI)

A preferred composition further comprises an alkanol amine, preferably monoethanol amine.

The composition of the invention can be Newtonian. When Newtonian, preferably, the composition has a Newtonian viscosity of from 1 mPa·s to 50 mPa·s, preferably from 1 mPa·s to 20 mPa·s, more preferably from 1 mPa·s to 10 mPa·s, at 20° C. as measured using the method defined herein. Preferably, the composition has a shear thinning rheology profile. This is important to allow the composition to be easily sprayed. The viscosity of the composition of the invention should also make the fluid to stay in vertical surfaces to provide cleaning and at the same time be easy to rinse. Especially suitable have been found compositions having a high shear viscosity at 1000 $s^{-1}$ of from 1 mPa·s to 50 mPa·s, preferably from 1 mPa·s to 20 mPa·s, more preferably from 5 mPa·s to 15 mPa·s, at 20° C., and a low shear viscosity at 0.1 $s^{-1}$ of from 100 mPa·s to 1,000 mPa·s, preferably from 200 mPa·s to 500 mPa·s, at 20° C. as measured using the method defined herein. Preferably the composition of the invention comprises a rheology modifier, more preferably xanthan gum.

A preferred composition of the invention has a neat pH range of from 8 to 13, preferably from 10 to 11.5, at 20° C. Preferably, the composition has a reserve alkalinity of from 0.1 to 0.3, expressed as g NaOH/100 mL of composition at a pH of 10. This pH and reserve alkalinity further contribute to the cleaning of tough food soils.

According to another aspect of the invention, there is provided a method of cleaning soiled dishware using the cleaning product according to the claims comprising the steps of:

a) optionally, pre-wetting the soiled dishware
b) spraying the cleaning composition onto the soiled dishware;
c) optionally, adding water to the soiled dishware during a period of time, preferably for a period of from 1 second to 30 seconds;
d) optionally, scrubbing the dishware; and
e) rinsing the dishware.

The method of the invention allows for faster and easier cleaning of dishware under running tap, especially when the dishware is lightly soiled. When the dishware is heavily soiled with tough food soils such as cooked-, baked- or burnt-on soils the method of the invention facilitates the cleaning when the soiled dishware is soaked with the product of the invention in neat form or diluted in water.

Test Methods

The following assays set forth must be used in order that the invention described and claimed herein may be more fully understood.

Test Method 1: Reserve Alkalinity

The reserve alkalinity for a solution is determined in the following manner A pH meter (for example An Orion® Model 720A from Thermo Scientific) with a Ag/AgCl electrode (for example an Orion sure flow Electrode model 9172BN) is calibrated using standardized pH 7 and pH 10 buffers. A 100 g of a 10% solution in distilled water at 20° C. of the composition to be tested is prepared. The pH of the 10% solution is measured and the 100 g solution is titrated down to pH 10 using a standardized solution of 0.1 N of HCl. The volume of 0.1 N HCl required is recorded in mL. The reserve alkalinity is calculated as follows:

Reserve Alkalinity=mL 0.1N HCl×0.1 (equivalent/liter)×Equivalent weight NaOH (g/equivalent)×10

Test Method 2: Viscosity

The rheology profile is measured using a "TA instruments DHR1" rheometer, with a flat steel Peltier plate and a 60 mm, 2.026° cone plate geometry (TA instruments, serial number: SN960912). The flow curve procedure includes a conditioning step and a flow sweep step at 20° C. The conditioning step comprises a 10 seconds soaking step at 20° C., followed by a 10 seconds pre-shear step at 10 $s^{-1}$ at 20° C., followed by a 30 seconds zero shear equilibration step 20° C. The flow sweep step comprises a logarithmical shear rate increase from 0.01 $s^{-1}$ to 3,000 $s^{-1}$ at 20° C., with a 10 points per decade acquisition rate, a maximum equilibration time of 200 seconds, a sample period of 15 seconds and a tolerance of 3%.

When measuring shear thinning product compositions the high shear viscosity is defined at a shear rate of 1,000 $s^{-1}$, and the low shear viscosity at a shear rate of 0.1 $s^{-1}$. For Newtonian product compositions the shear rate at 1,000 $s^{-1}$ is recorded.

Test Method 3: Stinging Test

The objective of the Stinging Test is to compare the level of stinging sensation and/or irritant sensations in subjects produced by test composition(s) vs. comparative composition(s) after spray application. Test composition is sprayed against a vertical wall of a clean dried stainless steel sink (footprint: 40 cm×40 cm; height: 24 cm) and its stinging performance is consequently assessed by panelists selected from individuals who are trained to evaluate stinging performance according to the scales below. The test is repeated with the comparative composition. The test is conducted in a standard conditioned lab at approximately 20° C. and approximately 40% humidity.

Spray Bottle Preparation: Any type of spray bottle can be used for the stinging assessment (e.g., Flairosol® type spray bottle commercially available from AFA Dispensing Group (the Netherlands)). Although, the same type of spray bottle should be used to conduct the testing with the test and comparative compositions.

Prime the nozzle of the spray bottle before the test by spraying the test composition 5 times in a separate sink positioned at least 5 meters away from the test sink. The priming action is to ensure there is no air nor liquid contamination in the spraying nozzle. Also, this priming action helps to verify the spray nozzle is not blocked and that the spray pattern is relatively consistent and as expected.

Stinging Test: Hold the spray bottle at about 15 cm from the vertical wall of a test sink (measuring 40 cm×40 cm footprint, 24 cm height) in a vertical position such that the reservoir remains in a vertical position so that all of the test composition can be sprayed using the spray mechanism. Spray the test composition 8 times at a spraying frequency of 1 spray per second and in a manner such that the sprays land sequentially on top of each other. Ensure all sprayed composition hits the vertical wall. After the last spray, the panelist immediately brings his/her nose to about 5 cm from the sink wall, near the top of the sprayed area, and inhales normally for 5 seconds. Panelist returns to the upright position and immediately assesses the sensations/smells detected according to the classification scale below. The sink is rinsed excessively with water to ensure that no remnant perfumes or chemistries remains prior to testing a new composition. Leave at least 15 minutes between different test compositions and avoid testing more than 4 compositions within a period of half a day, in order to prevent saturation of the nose. Repeat above steps with the comparative composition.

The irritant and/or stinging sensation is assessed by the panelist based on the following scale:

TABLE 1

| Classification | |
|---|---|
| 0 | Feel/smell nothing<br>No itching sensation in the nose and/or throat and no tearing in the eyes |
| 1 | Feel/smell nothing except normal perfume/composition smell<br>No itching sensation in the nose and/or throat and no tearing in the eyes |
| 2 | Start feeling some tingling in the nose that disappears very fast<br>Might also start feeling mild itching sensation in the nose and/or throat and/or tearing in the eyes |
| 3 | Feel mild tingling in the nose and throat<br>Might also feel mild itching sensation in the nose and/or throat and/or tearing in the eyes |
| 4 | Feel a need to cough and unpleasant feeling in nose/throat for longer duration<br>Might also feel strong itching sensation in the nose and/or throat and/or tearing in the eyes |

Test Method 4: Coloured Stain Removal Test

The objective of the coloured stain removal test is to visually cross-compare the ability of different testing formulations to extract coloured soils from surfaces. Therefore a cleaning composition is applied as a foam on a coloured stain (i.e., baked on tomato sauce—supplier: Center for Testmaterials, Netherlands—identification code: DP-02) and the coloured stain removal power is evaluated through visual assessment of the degree of foam colouration over time. Therefore, 5 mL of a foaming dishwashing product is transferred with a plastic pipette to a 28 mL glass vial (supplier: VWR). The product is consequently manually shaked for one minute at a frequency of about 2.5 shakes per second, wherein one shake consisting of an up and down movement of about 20 cm. The vial is switched hands at 30 seconds. 2.5 mL of the most dense section of the generated foam is taken from the glass vial and transferred to the soiled plate by using a plastic pipette. It is ensured that only the foam phase is transferred and no liquid, since the liquid phase can alternate the readings considerably. A timer is started immediately after foam application on the soiled plate and a first picture is taken at time zero. Subsequent pictures are taken every 30 seconds up to 4 minutes to follow the kinetics of the colouration of the foamed product. The relative degree of colouration of the foam is visually compared for different test products to assess their relative coloured stain removal performance.

EXAMPLES

The following examples are provided to further illustrate the present invention and are not to be construed as limitations of the present invention, as many variations of the present invention are possible without departing from its spirit or scope.

Example 1: Cleaning Composition Comprising Low Cut Alcohol Alkoxylate Non-Ionic Surfactant and Comparative Compositions The ability of a cleaning composition to extract coloured stains as well as its stinging performance has been assessed for a cleaning composition comprising the low cut alcohol alkoxylate non-ionic surfactant according to the invention (Inventive Composition 1). In parallel, comparative compositions are prepared by replacing the low cut alcohol alkoxylate non-ionic surfactant with the following: i) mid cut non-ionic surfactant (Comparative Composition 1); ii) organic grease cleaning solvents (Comparative Composition 2); or demineralized water (Comparative Composition 3). The foregoing compositions are produced through standard mixing of the components described in Table 2.

TABLE 2

| Inventive and Comparative Compositions: | | | | |
|---|---|---|---|---|
| Ingredients | Inventive Composition 1 | Comparative Composition 1 | Comparative Composition 2 | Comparative Composition 3 |
| AES (Tensagex EOC970 ex KLK OLEO) | 6.54% | 6.54% | 6.54% | 6.54% |
| C1214 dimethyl amine oxide | 2.46% | 2.46% | 2.46% | 2.46% |
| Lutensol ® CS6250 ex BASF | 5% | — | — | — |
| Neodol ™ 91-8 ex Shell | — | 5% | — | — |
| Dowanol ™ DPnB ex Dow | — | — | 5% | — |
| GLDA chelant ex AKZO | 1% | 1% | 1% | 1% |
| monoethanolamine | 0.5% | 0.5% | 0.5% | 0.5% |
| sodium bicarbonate | 0.1% | 0.1% | 0.1% | 0.1% |

TABLE 2-continued

| Inventive and Comparative Compositions: | | | | |
|---|---|---|---|---|
| Ingredients | Inventive Composition 1 | Comparative Composition 1 | Comparative Composition 2 | Comparative Composition 3 |
| PPG 2000 | 0.05% | 0.05% | 0.05% | 0.05% |
| Water and minors (0.25% perfume, preservatives) | Balance to 100% | Balance to 100% | Balance to 100% | Balance to 100% |
| pH | 11.4 | 11.4 | 11.4 | 11.4 |

Example 1a: Coloured Stain Removal Performance of Inventive and Comparative Compositions The resultant compositions including the Inventive Composition 1 and Comparative Compositions 1-3 are assessed according to the Colour Stain Removal Test method as described herein. The results of the test are shown in FIG. 1 (at 4 minutes datapoint). With reference to FIG. 1, the low cut alcohol alkoxylate non-ionic surfactant containing formulation of Inventive Composition 1 provides excellent coloured stain extraction performance, as evidenced by a resulting strongly coloured foam. Very limited coloured stain extraction is observed for Comparative Compositions 1 and 3, as evidenced by a resulting dominant white foam. Comparative Composition 2, containing an organic grease cleaning solvent provided moderate coloured stain removal performance, inferior to Inventive Composition 1.

Example 1b: Stinging/Irritation Performance of Inventive and Comparative Compositions The stinging/irritation performance of Inventive Composition 1 formulation comprising the low cut alcohol alkoxylate non-ionic surfactant according to the invention has been compared to Comparative Composition 2 comprising an organic grease cleaning solvent outside the scope of the invention, according to the Stinging Test method as described herein. The results of the Stinging Test are summarized in Table 3.

TABLE 3

| Stinging/Irritation Performance | | |
|---|---|---|
| | Inventive Composition 1 | Comparative Composition 2 |
| Stinging grade | 0 | 2 |

The results clearly show substantially reduced stinging/irritation for the low cut alcohol alkoxylate non-ionic surfactant containing formulation according to the invention (Inventive Composition 1) than the organic grease cleaning solvent containing formulation (Comparative Composition 2). While both the low cut alcohol alkoxylate non-ionic surfactant according to the invention as well as the organic grease cleaning solvent outside the scope of the invention extract coloured stains from a soiled surface, significantly reduced stinging has been observed for only the low cut alkoxylate non-ionic surfactant according to the invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning product comprising a spray dispenser and a cleaning composition suitable for spraying and foaming, the composition housed in the spray dispenser wherein the composition comprises:

i) from about 7% to about 12% by weight of the composition of a surfactant system, wherein the surfactant system comprises an anionic surfactant and a co-surfactant, wherein the anionic surfactant comprises a C12 to C14 alkyl ethoxylated sulfate surfactant having an average degree of ethoxylation of from about 2 to about 5 and the co-surfactant is an amine oxide surfactant; and ii) from about 1.5% to about 10%, by weight of the composition of a linear or branched low cut alcohol alkoxylate non-ionic surfactant, wherein the non-ionic surfactant consists essentially of a C6 alcohol ethoxylate surfactant comprising on average from 3 to 7 ethoxy groups;

wherein the surfactant system described under i) excludes the low cut alcohol alkoxylate non-ionic surfactant described under ii); and wherein the surfactant system and the low cut alcohol alkoxylate non-ionic surfactant are in a weight ratio of from about 5:1 to about 1:1; and wherein the composition is substantially non-irritating and/or non-stinging to the skin, eyes, nose, throat or combinations thereof of a consumer when sprayed from the spray dispenser.

2. The cleaning product according to claim 1, wherein the anionic surfactant and the co-surfactant are present in a weight ratio of from about 5:1 to about 1:5.

3. The cleaning product according to claim 1, wherein the amine oxide surfactant is selected from the group consisting of a linear C10 alkyl dimethyl amine oxide, a linear C12-C14 alkyl dimethyl amine oxide and mixtures thereof.

4. The cleaning product according to claim 1, wherein the composition further comprises from about 0.01% to about 5%, by weight of the composition of a thickening agent selected from the group consisting of polyethylene glycol, polyalkylene oxide, polyvinyl alcohol, polysaccharide and mixtures thereof.

5. The cleaning product according to claim 1, wherein the composition further comprises one or more ingredients selected from the group consisting of:

i) a glycol ether solvent selected from the group consisting of glycol ethers of:

a) Formula (I): R1O(R2O)nR3, wherein: R1 is a linear or branched C4, C5 or C6 alkyl or a substituted or unsubstituted phenyl; R2 is ethyl or isopropyl; R3 is hydrogen or methyl; and n is 1, 2 or 3;

b) Formula (II): R4O(R5O)nR6, wherein: R4 is n-propyl or isopropyl; R5 is isopropyl; R6 is hydrogen or methyl; and n is 1, 2 or 3; and c) mixtures thereof;

ii) an ester solvent selected from the group consisting of:

a) monoesters having the Formula (III): R1C═OOR2, wherein:

R1 is a linear or branched C1 to C4 alkyl; and

R2 is a linear or branched C2 to C8 alkyl;

b) di- or tri-esters having the Formula (IV): R1(C═OOR2)n, wherein:

R1 is a saturated or unsaturated C2 to C4 alkyl;

R2 is independently selected from a linear or branched C2 to C8 alkyl; and n is 2 or 3; and c) benzylbenzoate; and d) mixtures thereof;

iii) an alcohol solvent selected from the group consisting of C4-C6 linear mono-alcohols, branched C4-C10 mono-alcohols having one or more C1-C4 branching groups, alkyl mono-glycerols, and mixtures thereof;

iv) an alcohol solvent selected from the group consisting of C1-C3 linear of branched mono alcohols, C1-C3 polyols and mixtures thereof, a glycol solvent selected from the group consisting of ethyleneglycol, propyleneglycol, polyethyleneglycol, polypropyleneglycol, and mixtures thereof;

v) a hydrotrope selected from the group consisting of sodium cumene sulphonate, sodium xylene sulphonate, sodium toluene sulphonate, and mixtures thereof; and vi) mixtures thereof.

6. The cleaning product according to claim 1, wherein the composition further comprises a chelant, wherein the chelant is an aminocarboxylate selected from glutamic-N,N-diacetic acid (GLDA), methyl-glycine-diacetic acid (MGDA) or mixtures thereof.

7. The cleaning product according to claim 1, wherein the composition further comprises a builder.

8. The cleaning product according to claim 1, wherein the composition further comprises a cleaning amine selected from the group consisting of:

a. a cyclic cleaning amine of Formula (V):

(V)

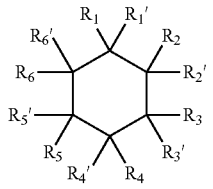

wherein two of the $R_1$ or $R_1'$-$R_6$ or $R_6'$, are selected from the group consisting of NH2, (C1-C4)NH2 and mixtures thereof and the remaining $R_1$ or $R_1'$-$R_6$ or $R_6'$ are independently selected from H, linear or branched alkyl or alkenyl having from 1 to 10 carbon atoms, wherein the cyclic diamine is selected from the group consisting of 1, 3-bis(methylamine)-cyclohexane, 2-methylcyclohexane-1,3-diamine, 4-methylcyclohexane-1,3-diamine and mixtures thereof;

b. polyetheramines of Formula (VI), Formula (VII), Formula (VIII) or mixtures thereof:

(VI)

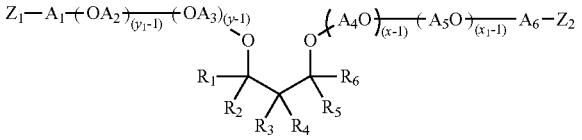

(VII)

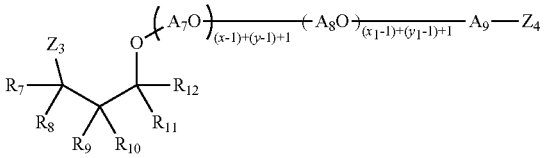

wherein each of $R_1$-$R_{12}$ is independently selected from H, alkyl, cycloalkyl, aryl, alkylaryl, or arylalkyl, wherein at least one of $R_1$-$R_6$ and at least one of $R_7$-$R_{12}$ is different from H, each of $A_1$-$A_9$ is independently selected from linear or branched alkylenes having 2 to 18 carbon atoms, each of $Z_1$-$Z_4$ is independently selected from OH or $NH_2$, wherein at least one of $Z_1$-$Z_2$ and at least one of $Z_3$-$Z_4$ is $NH_2$, wherein the sum of x+y is in the range of from 2 to 200, wherein x≥1 and y≥1, and the sum of $x_1+y_1$ is in the range of from 2 to 200, wherein $x_1 \geq 1$ and $y_1 \geq 1$;

(VIII)

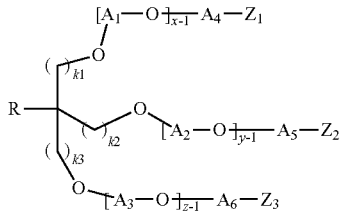

wherein R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from 2 to 18 carbon atoms or mixtures thereof, x≥1, y≥1, and z≥1, and the sum of x+y+z is in the range of from 3 to 100, each of $Z_1$, $Z_2$, and $Z_3$ is independently selected from $NH_2$ or OH, where at least two of $Z_1$, $Z_2$, and $Z_3$ are $NH_2$, and the polyetheramine has a weight average molecular weight of from 150 to 1000 grams/mole;

or mixtures thereof; and c. amines of Formula (IX), Formula (X), Formula (XI) or mixtures thereof:

(IX)

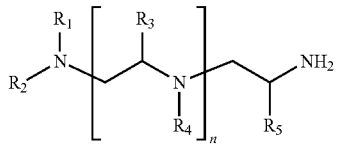

wherein: $R_1$, $R_2$, $R_3$, $R_4$, and $R_5$ are independently selected from —H, linear, branched or cyclic alkyl or alkenyl having from 1 to 10 carbon atoms and n=0-3; or (X)

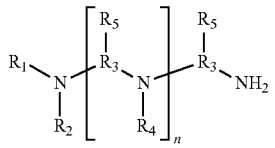

wherein $R_1$ and $R_4$ are independently selected from —H, linear, branched or cyclic alkyl or alkenyl having from 1 to 10 carbon atoms; and $R_2$ is a linear, branched or cyclic alkyl or alkenyl having from 3 to 10 carbons, $R_3$ is a linear or branched alkyl from 3 to 6 carbon atoms, $R_5$ is H, methyl or ethyl and n=0-3; or (XI)

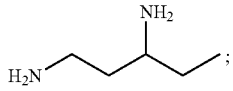

or mixtures thereof.

9. The cleaning product according to claim 1, wherein the composition further comprises an alkanol amine.

10. The cleaning product according to claim 1, wherein the composition has a Newtonian viscosity of from about 1 mPa·s to about 50 mPa·s, at about 20° C. as measured using the method defined herein.

11. The cleaning product according to claim 1, wherein the composition has a shear thinning rheology profile having a high shear viscosity at about 1000 $s^{-1}$ of from about 1 mPa·s to about 50 mPa·s, at about 20° C., and a low shear viscosity at about 0.1 $s^{-1}$ of from about 100 mPa·s to about 1,000 mPa·s, at about 20° C. as measured using the method defined herein.

12. The cleaning product according to claim 1, wherein the composition has a neat pH range of from about 8 to about 13, at about 20° C.

13. The cleaning product according to claim 1, wherein the composition has a reserve alkalinity of from about 0.1 to about 0.3, expressed as g NaOH/100 mL of composition at a pH of about 10.

14. A method of cleaning soiled dishware using the cleaning product according to claim 1, the method comprising the steps of:

a) optionally, pre-wetting the soiled dishware;

b) spraying the cleaning composition onto the soiled dishware;

c) optionally, adding water to the soiled dishware during a period of time;

d) optionally, scrubbing the dishware; and e) rinsing the dishware.

* * * * *